US007048312B2

(12) United States Patent
Brunner

(10) Patent No.: US 7,048,312 B2
(45) Date of Patent: May 23, 2006

(54) SAFETY MECHANISM FOR WALK-IN INTERIORS, PARTICULARLY FOR COOKING DEVICES

(75) Inventor: Hubert Brunner, Weil (DE)

(73) Assignee: Rational AG, Landsberg/Lech (DE)

( * ) Notice: Subject to any disclaimer, the term of this patent is extended or adjusted under 35 U.S.C. 154(b) by 0 days.

(21) Appl. No.: 10/236,523

(22) Filed: Sep. 6, 2002

(65) Prior Publication Data

US 2003/0047949 A1 Mar. 13, 2003

(30) Foreign Application Priority Data

Sep. 6, 2001 (DE) ..... 101 43 640

(51) Int. Cl.
*E05C 1/08* (2006.01)

(52) U.S. Cl. ..... 292/163; 292/92; 292/137; 292/165; 292/169.12; 292/341.15; 292/341.16; 292/341.17; 292/DIG. 69; 292/DIG. 71; 70/92

(58) Field of Classification Search ..... 292/163, 292/165, DIG. 69, 251.5, 92, 137, 164, DIG. 65, 292/169.12, DIG. 71, 302, 341.15, 341.16, 292/341.17; 70/92; 52/36.1; 126/197
See application file for complete search history.

(56) References Cited

U.S. PATENT DOCUMENTS

| | | | | | |
|---|---|---|---|---|---|
| 1,203,394 | A | * | 10/1916 | Ottinger | 292/177 |
| 1,578,779 | A | * | 3/1926 | Titus | 292/164 |
| 1,593,372 | A | * | 7/1926 | Thompson | 292/164 |
| 1,787,296 | A | * | 12/1930 | Wild | 292/341.15 |
| 1,880,637 | A | * | 10/1932 | Wood | 292/169.12 |
| 1,908,388 | A | * | 5/1933 | Watson | 292/164 |
| 2,003,394 | A | * | 6/1935 | Sell | 292/182 |
| 2,012,732 | A | * | 8/1935 | Schmidgall | 292/226 |
| 2,106,951 | A | * | 2/1938 | Hubbell | 70/149 |
| 2,167,594 | A | * | 7/1939 | Stratman | 70/153 |
| 2,201,444 | A | * | 5/1940 | Marsh | 292/165 |
| 2,510,019 | A | * | 5/1950 | Holland | 292/26 |
| 2,726,533 | A | * | 12/1955 | Quinn | 70/153 |
| 2,746,782 | A | * | 5/1956 | Schamotta | 292/92 |
| 2,747,906 | A | * | 5/1956 | Emmert | 292/92 |
| 2,762,645 | A | * | 9/1956 | Bordner | 292/341.17 |
| 2,765,648 | A | * | 10/1956 | Hatcher | 70/264 |
| 2,772,107 | A | * | 11/1956 | Youngberg | 292/108 |
| 2,772,110 | A | * | 11/1956 | Petrochko | 292/341.17 |
| 2,830,547 | A | * | 4/1958 | Zieche | 109/63.5 |
| 2,956,828 | A | * | 10/1960 | Clark | 292/251.5 |
| 2,966,864 | A | * | 1/1961 | Weaver | 109/63.5 |
| 3,066,964 | A | * | 12/1962 | Lemaire | 292/173 |
| 3,161,036 | A | * | 12/1964 | Himes et al. | 70/150 |
| 3,346,288 | A | | 10/1967 | Cosentino | |

(Continued)

FOREIGN PATENT DOCUMENTS

| | | | |
|---|---|---|---|
| AT | 363804 | * | 9/1981 |

(Continued)

*Primary Examiner*—Brian E. Glessner
*Assistant Examiner*—Carlos Lugo
(74) *Attorney, Agent, or Firm*—Marshall, Gerstein & Borun LLP

(57) ABSTRACT

A walk-in chamber has a door opening closable by a door, which, when in the closed position can be either in a locked position or an unlocked position, dependent on the locking device, which includes a sliding bolt engageable with a locking bolt. To enable a person in the chamber to disengage the locking device, a safety mechanism is provided which enables moving the sliding bolt from an engaging position to a retracted position to enable a person to open the door.

27 Claims, 4 Drawing Sheets

U.S. PATENT DOCUMENTS

| | | | | | |
|---|---|---|---|---|---|
| 3,449,006 | A | * | 6/1969 | Andrew | 292/346 |
| 3,765,709 | A | * | 10/1973 | Van Wyck | 292/33 |
| 3,786,657 | A | * | 1/1974 | Loikitz | 70/150 |
| 3,934,435 | A | * | 1/1976 | Gresham | 70/150 |
| 3,936,086 | A | | 2/1976 | Berkowitz | |
| 3,998,483 | A | * | 12/1976 | Yan | 292/254 |
| 4,203,622 | A | * | 5/1980 | Cook et al. | 292/221 |
| 4,399,755 | A | * | 8/1983 | Wiedmann | 109/2 |
| 4,439,808 | A | * | 3/1984 | Gillham | 361/144 |
| 4,480,451 | A | * | 11/1984 | Fujiya | 70/92 |
| 4,547,008 | A | * | 10/1985 | Takasaki | 292/341.15 |
| 4,569,546 | A | * | 2/1986 | Howard et al. | 292/336.3 |
| 4,623,181 | A | * | 11/1986 | Geringer et al. | 292/336.3 |
| 4,635,977 | A | * | 1/1987 | Yamada | 292/92 |
| 4,714,285 | A | * | 12/1987 | Langham | 292/163 |
| 4,741,275 | A | * | 5/1988 | Lewiner et al. | 109/7 |
| 4,848,812 | A | * | 7/1989 | Slaughter | 292/144 |
| 4,904,005 | A | * | 2/1990 | Frolov | 292/251.5 |
| 5,280,974 | A | * | 1/1994 | Weintroub | 292/164 |
| 5,285,604 | A | * | 2/1994 | Carlin | 52/79.1 |
| 5,529,354 | A | * | 6/1996 | Studt et al. | 292/336.3 |
| 5,542,211 | A | * | 8/1996 | Colombo | 49/42 |
| 5,556,140 | A | | 9/1996 | Sakagami | |
| 5,732,614 | A | * | 3/1998 | Oslin | 99/341 |
| 5,816,137 | A | * | 10/1998 | Gongwer et al. | 99/345 |
| 5,823,026 | A | * | 10/1998 | Finke | 70/276 |
| 5,946,919 | A | * | 9/1999 | McKinney et al. | 62/3.7 |
| 6,022,056 | A | | 2/2000 | Cope et al. | |
| 6,121,583 | A | * | 9/2000 | Hansen | 219/401 |
| 6,167,797 | B1 | * | 1/2001 | Bollich | 99/340 |
| 6,298,603 | B1 | * | 10/2001 | Diaz | 49/68 |
| 6,474,247 | B1 | * | 11/2002 | Thomas | 109/2 |

FOREIGN PATENT DOCUMENTS

| | | |
|---|---|---|
| DE | 40 33 840 | 4/1992 |
| EP | 0 143 332 | 8/1988 |
| EP | 0 323 580 | 7/1989 |
| EP | 0 959 208 | 11/1999 |
| GB | 720764 | 2/1953 |
| GB | 1 141 585 | 6/1967 |
| GB | 2 154 646 | 9/1985 |
| GB | 2 275 733 | 9/1994 |

* cited by examiner

SAFETY MECHANISM FOR WALK-IN INTERIORS, PARTICULARLY FOR COOKING DEVICES

BACKGROUND OF THE INVENTION

The present invention is directed to a safety mechanism or device for an accessible chamber closable by a door, particularly for an oven or a cooking device. The door for the accessible chamber is movable between an open position, in which access to the chamber is open; a closed position, in which access to the chamber is closed; an unlocked position or condition, in which the closed position is unlocked; and a locked condition or position, in which the closed position is locked. The door can be moved between the locked position and the unlocked position from a device which is operated from the outside of the chamber and has a lever, and a safety device, which can move it into the unlock position, which is operated from inside the chamber.

Various safety devices for doors are known in the prior art. GB 2 154 646 A discloses a safety device or emergency release mechanism for doors of freight containers, transport vehicles and the like. This emergency release mechanism for a door lock enables a person accidentally enclosed in the container or the vehicle to open the container door from the interior. An operating rod rotatable by a lever is disposed on the outside of the door and has ends with cams for engaging and locking in holding means mounted on the door frame, so that the door can be locked from the exterior by rotating the control rod via the lever. When the door is locked, the lever is in a receiving device, which can be unfastened from the inside of the door. In an emergency, therefore, a person can release the receiving device from the door and push it away therefrom, which will lead to a turning of the lever and, thus, the operating rod to release the door. What is a disadvantage about this mechanism, however, is that the door cannot be opened from the inside when the outer lock mechanism is blocked from the inside or when a person is maliciously shut inside the container.

EP 0 959 208 A1 also discloses a safety release mechanism for a door, for example a climatic chamber. This mechanism makes it possible to move a receptacle device for a lever connected to an operating rod from the inside of the door in order to achieve a rotation of the operating rod and, thus, an unlocking of the door. This device or mechanism, however, has the same disadvantage that was present in GB 2 154 646 A, for example the unlocking of the door can be prevented by blocking the lock mechanism from the exterior.

U.S. Pat. No. 6,022,056 discloses an automatic door spring catch drive incorporated in a door frame and used for operating a locking bolt arrangement on a door. The arrangement comprises a spring bolt and a mortise bolt for locking the spring bolt. The drive is constructed so that the two bolts can be successively operated for opening the door. The complicated construction of this device is a disadvantage.

SUMMARY OF THE INVENTION

An object of the present invention is to improve the safety mechanism or device for unlocking a door for a walk-in interior chamber, particularly for cooking devices or ovens, which mechanism overcomes the disadvantages of the prior art in a structurally simple way. In particular, a safety mechanism which enables unlocking a door for a walk-in chamber from the inside, even when the lock mechanism operable from the outside has been blocked.

According to the invention, this problem is solved by a sliding bolt, which is biased by a spring to form a spring bolt, which is disposed either on the inside or the outside of the wall of the chamber for the moving door and from the inside or the outside of the chamber at the door opening and may be moved to a locked position in which the spring bolt engages a locking bolt which is operably connected with a lever, which can move the locking bolt between a locked position and an unlocked position. The improvements are that a release device, which is actuated from the interior of the chamber, can be passively or actively moved so as to unlock the door by moving the spring bolt.

It can be provided that the release device is operated mechanically or pneumatically via at least one actuating element, such as a lever, a pull handle, a traction cable, a press-button or a rotary wheel and an element, preferably in the form of a grate or the like, which is disposed particularly at the bottom of the chamber, is movable in at least one direction of space, and is connected to at least one transmission element, for example in the form of a linkage, a fork device, a cam, a cable line, a drive, a guide pulley and the like.

According to another proposed feature of the invention, the release device or triggering mechanism works electromagnetically upon utilization of at least one permanent magnet and at least one electromagnet, wherein the permanent magnet is preferably attached to the spring bolt.

An advantageous embodiment of the invention is characterized by at least one detecting device for detecting the presence of a person in the interior of the chamber, which detection device has the form of a motion sensor, an infrared sensor, a weight sensor—which may be in the form of a strain gauge—, a reed contact or a microswitch, inside the interior of the chamber and the detecting device is respectively connectible to the triggering mechanism.

A development of the inventive safety mechanism is characterized by at least one spring device by means of which a pre-stressed spring bolt forces the door into its unlocked position or locked position when a person is not present in the chamber. Optionally, according to the present invention, the spring bolt is disposed outside the chamber and the release mechanism is disposed at least partially inside the chamber and the spring bolt is connectible to the release mechanism inside the chamber through a wall of the chamber or through the door, particularly via a shaft that is preferably conducted vapor-tight through the wall of the door by means of a radial seal.

It can be inventively provided that the spring bolt is movable with an electric motor, particularly via the shaft.

It is also inventively preferred if an auxiliary energy supply in the form of, for instance, a battery, a rechargeable photovoltaic cell and/or a rechargeable accumulator, is provided with the triggering mechanism.

Over and above this, it is proposed that the spring bolt and the locking bolt are implemented complementary relative to one another in the region of the mutual engagement and particularly comprise correspondingly beveled surfaces.

It can also be provided that an element, such as a lever, is arranged in the interior, particularly the actuating element, is detachable and is fashioned as a tool, particularly for breaking a pane of glass installed in a door or for jimmying the door open.

Finally, an inventive safety mechanism can be characterized by a display unit via which the presence of a person in the interior can be displayed, particularly in the closed position and/or locked position of the door, preferably upon emission of an alarm signal or, in particular, an acoustic and/or optical nature, whereby the display unit is preferably connectible to the sensor, to the triggering mechanism and/or to a regulating and/or control device.

The invention is based on the surprising perception that a safety mechanism can be implemented so that the opening of, particularly, a cooking chamber door is possible proceeding from the interior of the cooking chamber of the cooking device, even when a lock mechanism arranged on the outside of the cooking chamber door is blocked such that it holds the cooking chamber door in a locked position. The spring bolt for engaging the locking mechanism in the locked position can be unlocked by a release device, thus, moving the cooking chamber door into an unlocked position. The device comprises an accessible inner chamber, which is equipped with a safety device according to the invention can thus be safely used in a number of situations, for example, even in penal institutions and the like.

Other advantages and features of the invention will be readily apparent from the following description, the claims and drawings.

DESCRIPTION OF THE PREFERRED EMBODIMENTS

Figure 1:
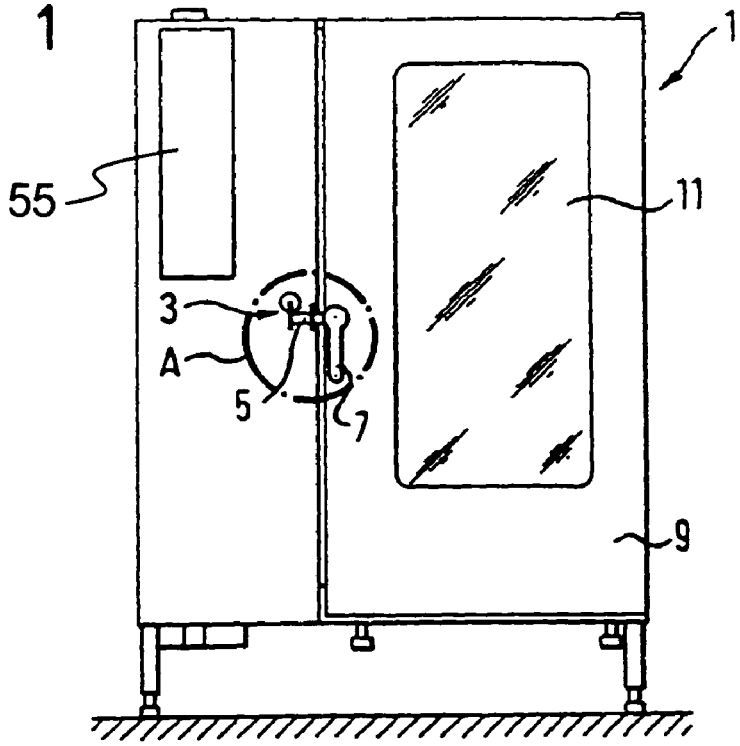
FIG. 1 is a front elevational view of an oven with a closed cooking chamber which has a first embodiment of the safety device according to the present invention.

The principles of the present invention are particularly useful when incorporated in a safety device, generally indicated at 3, for a cooking device or oven, generally indicated at 1. The safety device 3 comprises a sliding bolt which is also part of the lock mechanism and is biased by a spring to form a spring bolt 5 and an operating lever 7 for opening and closing the cooking chamber door 9 from the outside of the cooking chamber or oven. The cooking chamber door 9 shown in the closed position or locked position in a door opening also has an inspection window 11.

Figure 2:
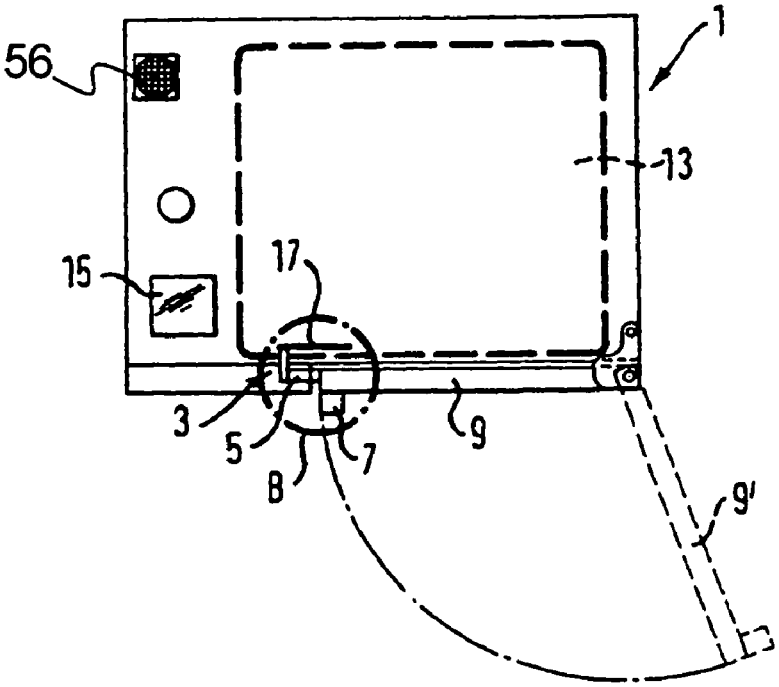
FIG. 2 is a top plan view of the oven or cooking device of FIG. 1.

As illustrated in FIG. 2, the door 9 can be swung to an open position 9', which is shown in broken lines. As also shown in FIG. 2, the oven 1 comprises a cooking chamber 13 shown in broken lines and an auxiliary energy supply in the form of a photovoltaic cell 15. The safety device 3 comprises a release lever 17, which is positioned inside the cooking chamber 13.

Figure 3:
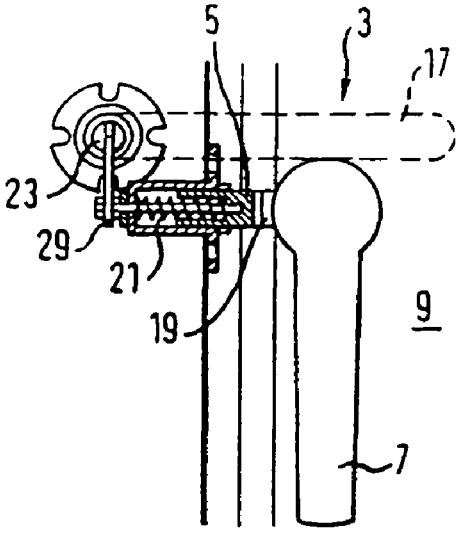
FIG. 3 is an enlarged detailed view with portions broken away for purposes of illustration of a portion in the circle A of FIG. 1.
Figure 4:
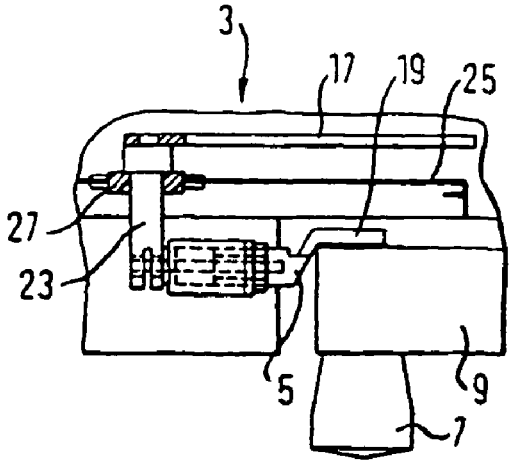
FIG. 4 is an enlarged detailed view with portions broken away for purposes of illustration of a portion in the circle B of FIG. 2.

The operation of the first embodiment of the safety device according to the present invention will be now described with reference to FIGS. 3 and 4, which are detailed views of the safety device 3 enclosed in a circle A of FIG. 1 and B of FIG. 2. In FIGS. 3 and 4, the cooking chamber door 9 is shown in a locked position in which the spring bolt 5 is in engagement with a locking bolt 19.

The door 9 can be locked in two ways. On the one hand, the lever 7 can be in an unlocked position while the door is closed. When the door is in the unlocked closed position, the lever 7 and, consequently, the locking bolt 19 can be moved into the locked position so that the bolt 19 comes into engagement with the spring bolt in the locked position and locks the door 9 in a closed position. If, on the other hand, the lever 7 and, consequently, the bolt 19 are already in the locked position when the cooking chamber door 9 closes, the spring bolt 5 will be designed so that it can briefly move out of the locking position shown in FIGS. 3 and 4 to allow it to pass behind the bolt 19. To this end, the bolt 19 and the spring bolt 5 have correspondingly beveled surfaces, so that while the door is closing, the spring bolt 5 is moved against the action of a spring device 21 out of the locked position and is finally snapped back into the locked position by the force built up by the spring device 21 as soon as the door 9 has reached the closed position and, thus, the spring bolt 5 will engage the locking bolt 19 to lock the door.

To open the door, the lever 7 must be rotated so that the bolt 19 rotates out of engagement with the spring bolt 5, for example it is moved out of the locked position into an unlocked position. When the bolt 19 is disengaged from the spring bolt 5, the door 9 is unlocked and can be opened into the open position.

According to the invention, after actuating and opening the door 9, the lever 7 is automatically moved back by a spring device (not shown) into a locked position shown in FIGS. 3 and 4.

The door 9 may also be actively opened by a person in the chamber 13 via a release lever 17, which is connected to a shaft 23 extending through a wall 25 of the cooking chamber. The passage for the shaft 23 in the wall 25 is sealed in a vapor-tight manner by a seal 27, such as a radial or motor shaft seal, so that a steamed cooking process can be implemented in the cooking chamber 13 of the cooking device essentially without an escape of steam. As is well known in the art, a seal system (not shown) is provided between the door and the door opening to prevent escape of the steam. A fork device 29 for connecting the shaft 23 to the spring bolt 5 is disposed at the end of the shaft 23 remote from the lever 17. If, when the door 9 is in the locked position, the person in the cooking chamber rotates the lever 17 in a clockwise direction or presses down on the lever 17, as illustrated in FIGS. 3 and 4, the fork device 29 will engage the spring bolt 5 and retract the spring bolt from the locked position. The bolt 19 is thus disengaged from the spring bolt 5 and unlocks the door 9 from the inside so that it can be subsequently opened. The unlocking occurs independent of the state of the lever 7 and, consequently, independent of the position of the bolt 19, particularly even when the lever 7 is in the locked position. Even if the lever 7 is in the locked position and the door 9 is in the closed position, the safety device can open the cooking chamber door 9.

Optionally, the connection between the release lever 17 and the shaft 23 is made releasable and the lever 17 can also be used to break the inspection window 11 of the door 9 or can be used as a tool, such as a crowbar, for jimmying the cooking chamber door open, even if the door is blocked from the exterior by an article of furniture or the like.

Figure 5:
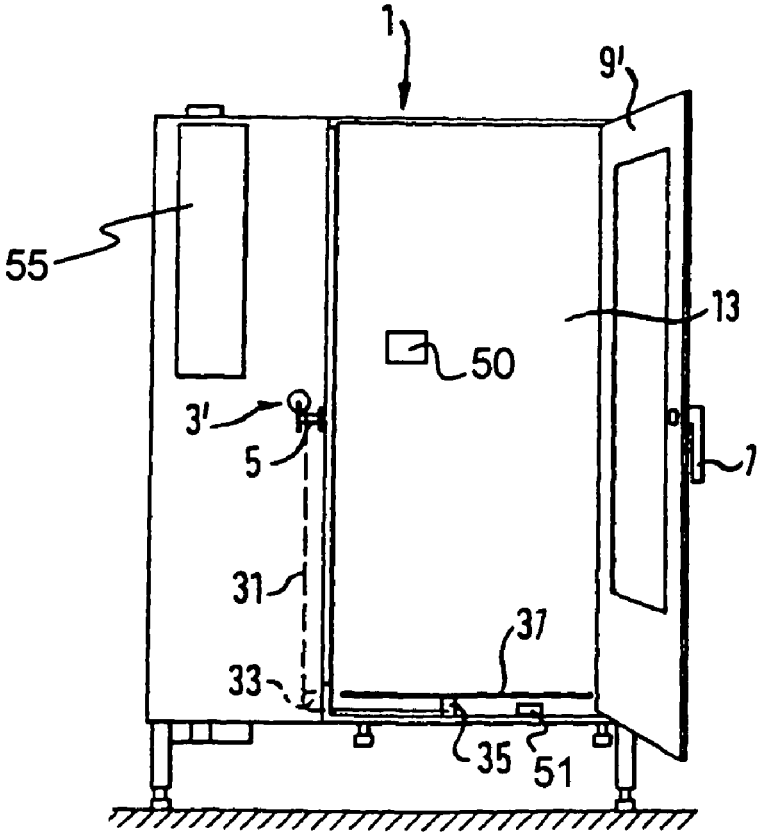
FIG. 5 is a front elevational view of an oven with an open cooking chamber showing a second embodiment of the safety device according to the present invention.

A second embodiment of the safety device is generally indicated at 3' in FIG. 5. In contrast to the first embodiment of the safety device 3 of FIGS. 3 and 4, the second embodiment of the safety device 3' does not have a release lever 17. Instead, the shaft 23 is connected to a wire cable 31 connected via a guide pulley 33 to a bearing 35 of a grating 37 disposed at the bottom of the cooking chamber 13. If a person is shut in the cooking device 13, he can rotate the grating 37. The rotation is transmitted via the wire cable 31 to the safety device 3', so that the spring bolt 5 is moved out of its locked position into an unlocked position and consequently unlocks the door 9 so that it may be opened to the position 9'. Optionally, also, the spring bolt 5 can be moved not only by rotation of the grating 37 but also by horizontal or vertical movement thereof, more particularly vertical movement of the grating 37 under the weight of the user on the grating, so that the user shut in the chamber 13 can operate the safety device 3' passively instead of actively. Optionally, also, the motion of the grating 37 is transmitted to the safety device 3' by a linkage, which is not shown.

Figure 6A:
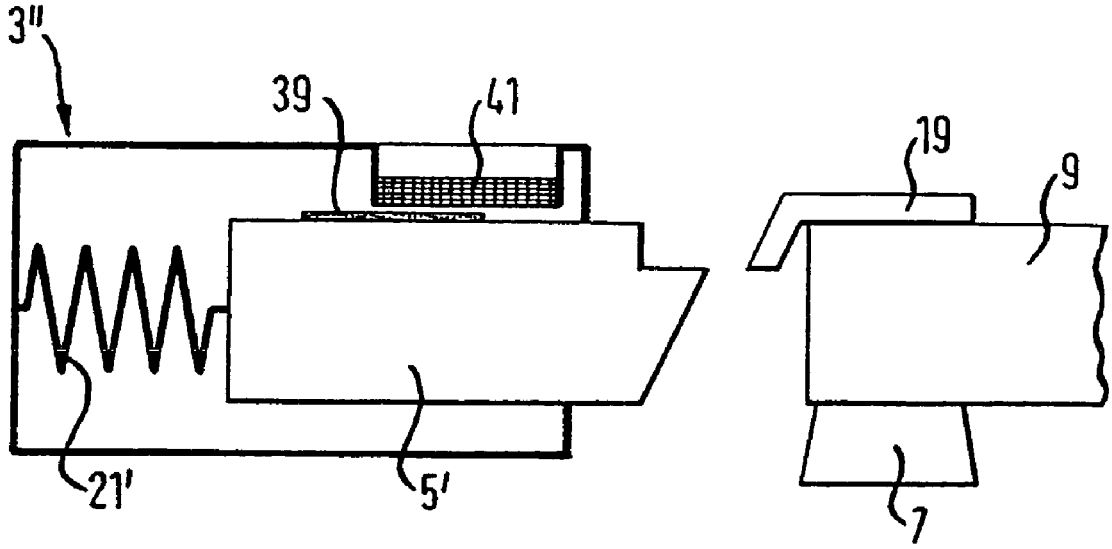
FIG. 6*a* is an enlarged detailed view with portions broken away for purposes of illustration of a third embodiment of the safety device of the present invention with the spring bolt in an unlocked position.
Figure 6B:
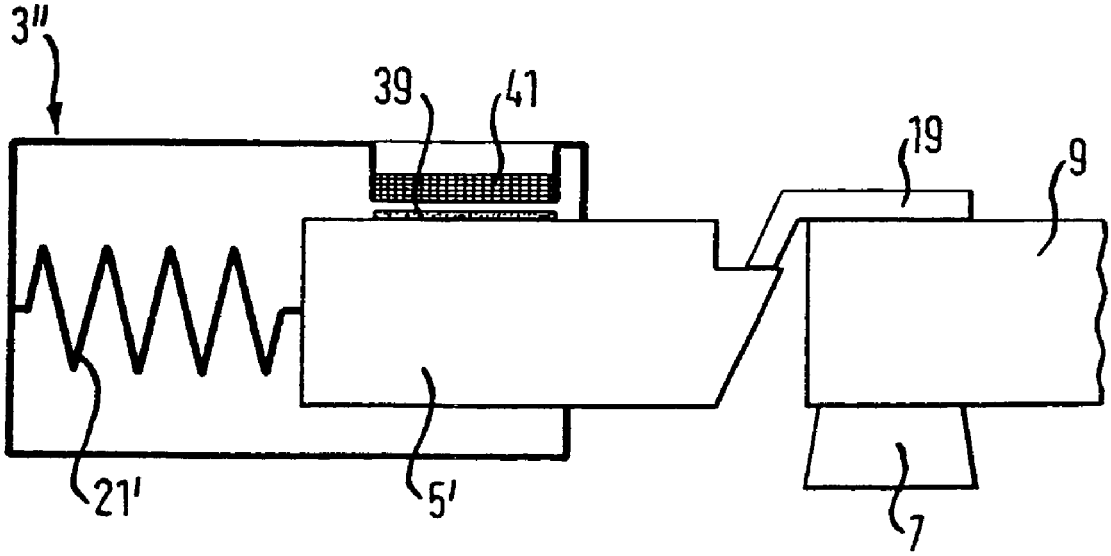
FIG. 6*b* is an enlarged detailed view with portions broken away for purposes of illustration of a third embodiment of the safety device according to FIG. 6*a* with the spring bolt in the locked position.

A third embodiment of the safety device, generally indicated at 3" in FIGS. 6*a* and 6*b*. The safety device 3" has a spring bolt 5' and a spring device 21'. A permanent magnet 39 is disposed on the spring bolt 5' near an electromagnet 41. As illustrated in FIG. 6*a*, the spring bolt 5' is in the unlocked position when the electromagnet 41 is not energized. The spring device 21' forces the spring bolt 5' to the unlocked position so that it cannot engage the bolt 19 on the door 9. This insures that the door 9 cannot be locked when the energy supply fails. If, however, an electrical current flows through the electromagnet 41, the magnetic interaction between the electromagnet 41 and the permanent magnet 39 causes the spring bolt 5' to move against the action of the spring device 21' into the locked position shown in FIG. 6*b*, wherein it engages the bolt or catch 19 on the door.

Optionally, the door 9 can be unlocked if a person who is shut in the interior of the cooking chamber 13 actuates a switch or the like, which actively influences the current flowing through the electromagnet so that an unlocking of the door 9 occurs. Optionally, also, the door 9 can be passively unlocked by this person. To this end, the electromagnet 41 is connected to a control device (not shown), which is connected to a sensor 50 (see FIG. 5). If the sensor 50 detects a person in the cooking chamber 13, the power supply to the electromagnet 41 is broken or deactivated and the spring bolt 5' is moved by the spring device 21' into the unlocked position shown in FIG. 6*a*. The sensor can also be an electrical switch 51, such as a microswitch or a reed contact disposed on the bottom of the chamber and triggered by deformation of the chamber floor caused by the weight of the person.

The sensor 50 or 51 can also activate a display unit when a person is inside the chamber 13 and the door 9 is closed. The display may be an optical display, such as 55 in FIGS. 1 and 3, or an acoustical display, such as 56 in FIG. 2.

In a modification of the embodiment of FIG. 3 of the safety device, the spring device holds a spring bolt having the permanent magnet in a locked position. The electromagnet, such as 41, is offset to the left from the position shown in FIG. 6*b* when the spring bolt 5' is in the locked position. If an electrical current is then sent to the electromagnet, the interaction between the electromagnet and the permanent magnet moves the spring bolt out of the locked position and into an unlocked position similar to that of FIG. 6*a*. To prevent the unlocking of the cooking door becoming impossible if the main energy supply to the oven is interrupted, the safety device is connected, in this case, to a control device via an auxiliary energy supply, for example in the form of a photovoltaic cell 15.

Figure 7:
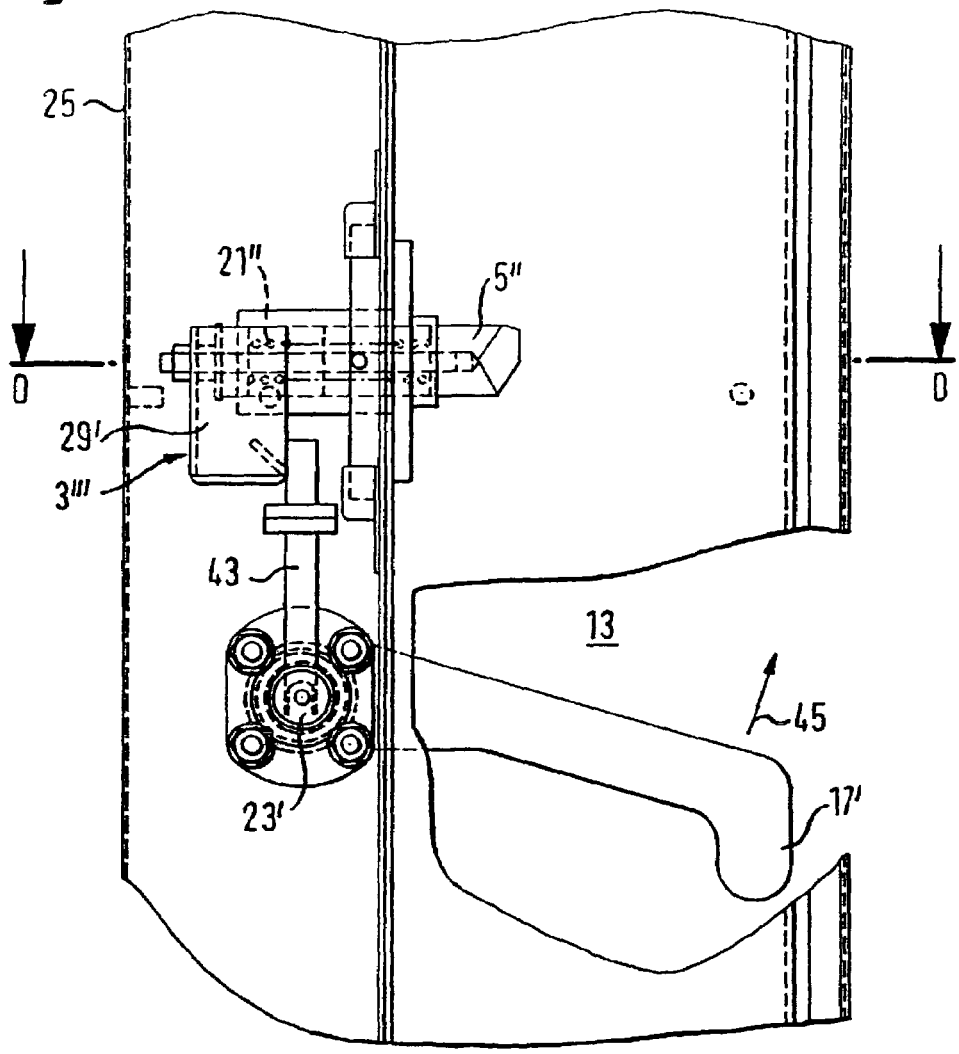
FIG. 7 is a partial front view of an oven with a fourth embodiment of the safety device according to the present invention with portions broken away for purposes of illustration.
Figure 8:
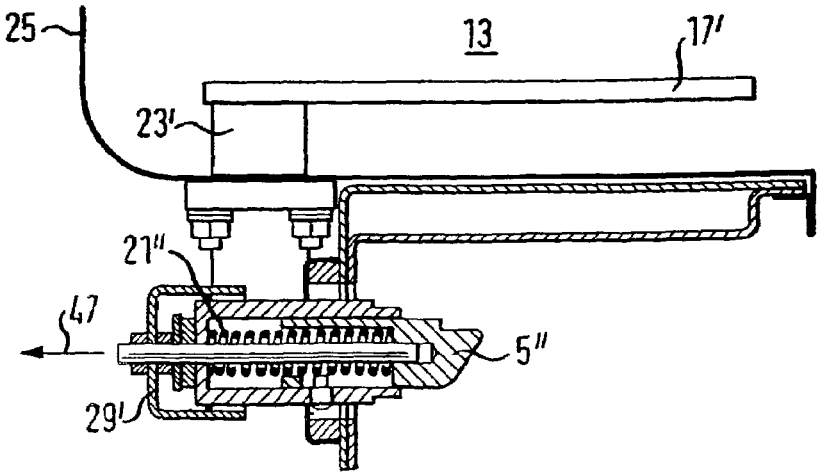
FIG. 8 is a cross sectional view of the fourth embodiment taken along the line D—D of FIG. 7.

A fourth embodiment of the safety device is generally indicated at 3''' in FIGS. 7 and 8. A release lever 17' is disposed on the side of the wall 25 facing inward to the cooking chamber 13. The lever 17' is connected to a shaft 23' extending through the wall 25, as shown in FIG. 8. A cam 43 is mounted on the shaft 23' and mechanically interacts with a fork device 29', which is coupled as before to the spring bolt 5", which is biased to a locking position by a spring device 21".

The safety device 3''' is released as follows: If a person is inside the chamber 13, he can release the safety device 3''' by swinging the lever 17' into an open position, as indicated by the arrow 45 of FIG. 7. This rotation of the shaft 23 thus moves the cam 43 outward. Owing to the interaction between the cam 43 and the fork device 29', the movement also results in moving the fork device 29' and, thus, retracting the spring bolt 5" in the direction indicated by the arrow 47 to an unlocked position. The spring bolt 5" is thus moved out of the locked position shown in FIGS. 7 and 8 into an unlocked position against the action of the spring device 21", which is a compression spring. Since the spring bolt 5" cannot engage when a cooking chamber door (not shown in FIGS. 7 and 8) is in the unlocked position, the door can be opened by the person in the chamber after actuation of the lever 17'.

Although various minor modifications may be suggested by those versed in the art, it should be understood that I wish to embody within the scope of the patent granted hereon all such modifications as reasonably and properly come within the scope of my contribution to the art.

I claim:

1. A safety locking mechanism in a walk-in cooking chamber having a door opening closed by a door, comprising:

a door locking bolt mounted to the cooking chamber door and with a connected operating lever exterior of the cooking chamber, said door locking bolt having an engagement surface, and said operating lever moving the bolt from a locking position to an unlocked position;

a sliding bolt having an engagement surface engageable with the engagement surface of the locking bolt and mounted at the door opening adjacent to the door locking bolt when the door is closed, said sliding bolt and the locking bolt having corresponding camming surfaces so that moving the door to the closed position causes the locking bolt camming surface to strike the sliding bolt camming surface to cause the sliding bolt to move to allow movement of the sliding bolt past the locking bolt; and, a triggering mechanism located at least partially inside the cooking chamber which can be actuated by a person in an interior of the cooking chamber and by which the sliding bolt can be moved from an engaging position to an unlocked position where the engagement surface of the sliding bolt cannot engage with the engagement surface of the door locking bolt independently of whether the door locking bolt is in the locking position or in the unlocked position, wherein the triggering mechanism connects to the sliding bolt through at least a part of a wall of the cooking chamber by a shaft of the triggering mechanism conducted at least partly through the chamber wall and, wherein the shaft of the triggering mechanism has a lever element engaging the sliding bolt so that rotation of said shaft moves the sliding bolt to a retracted position from a locked position.

2. A safety locking mechanism of claim 1, wherein the shaft is connected by a linkage arrangement to a grating adjacent a floor of the chamber, so that application of weight of a person in the chamber on the grating causes rotation of the shaft to retract the sliding bolt.

3. A safety locking mechanism of claim 1, which includes a display unit which indicates presence of a person in an interior of the chamber, said display unit providing a signal selected from acoustical signals and optical signals, and said display unit being actuated by a sensor of the triggering mechanism.

4. A safety locking mechanism of claim 1 wherein the triggering mechanism moves the sliding bolt to said unlocked position by an actuating element, said actuating element being at least one of a lever, a pulling handle, a traction cable, a pushbutton, a turning wheel, and an element disposed at a floor of the interior of the chamber and movable by a person in the interior connected to at least one transmission element in a form of a rodding, a fork mechanism, a cam, a cable pull, a gearing, and a deflection roller.

5. A safety locking mechanism according to claim 1, wherein the triggering mechanism is electromagnetically actuated and wherein the sliding bolt has one of an electromagnet and a permanent magnet mounted thereon and with a corresponding one of electromagnetic and permanent magnet being mounted in a housing receiving the sliding bolt.

6. A safety locking mechanism according to claim 5 which includes at least one sensor for detecting presence of a person in the interior of the chamber, said sensor being connected to an electrical circuit for the electromagnet so that a signal from said sensor causes movement of the sliding bolt to a retracted position to unlock the door.

7. A safety locking mechanism of claim 6 which includes a spring element urging the sliding bolt to a retracted position, and wherein energizing the electromagnet causes the sliding bolt to be moved to a position for engaging the locking bolt, and said sensor causes interruption of current applied to the electromagnet so as to allow the spring element to retract the sliding bolt.

8. A safety locking mechanism of claim 1 wherein the triggering mechanism shaft is conducted in substantially vapor-tight fashion through the chamber wall.

9. A safety lock mechanism of claim 1 wherein the sliding bolt is mounted in a frame of the door mounted to an outside surface of the chamber wall.

10. A safety locking mechanism of claim 1 wherein the door is free to move between the open and closed positions when the sliding bolt is in the unlocked position regardless of whether the door locking bolt is in the locking or unlocking position.

11. A safety locking mechanism of claim 1 wherein a spring biases the sliding bolt into said engaging position.

12. A safety locking mechanism of claim 11 wherein the sliding bolt moves against the biasing spring to allow movement of the sliding bolt past the locking bolt when the sliding bolt camming surface strikes the locking bolt camming surface.

13. A safety locking mechanism in a walk-in cooking chamber having a door opening closed by a door, comprising:

a door locking bolt mounted to the cooking chamber door and with a connected operating lever exterior of the cooking chamber, said door locking bolt having an engagement surface, and said operating lever moving the bolt from a locking position to an unlocked position;

a sliding bolt having an engagement surface engageable with the engagement surface of the locking bolt and mounted at the door opening adjacent to the door locking bolt when the door is closed, said sliding bolt and the locking bolt having corresponding camming surfaces so that moving the door to the closed position causes the locking bolt camming surface to strike the sliding bolt camming surface to cause the sliding bolt to move to allow movement of the sliding bolt past the locking bolt; and, a triggering mechanism located at least partially inside the cooking chamber which can be actuated by a person in an interior of the cooking chamber and by which the sliding bolt can be moved from an engaging position to an unlocked position where the engagement surface of the sliding bolt cannot engage with the engagement surface of the door locking bolt independently of whether the door locking bolt is in the locking position or in the unlocked position, wherein the triggering mechanism connects to the sliding bolt through at least a part of a wall of the cooking chamber by a shaft of the triggering mechanism conducted at least partly through the chamber wall and, wherein an actuation element is detachably connected to the shaft for rotating the shaft to move the sliding bolt to a retracted position, said actuating element being designed as a tool and being removable for selectively breaking a pane in a window of the door and for jimmying the door open.

14. A cooking device comprising a walk-in cooking chamber having a door opening closed by a door, and a safety locking mechanism, said safety locking mechanism comprising:

a door locking bolt mounted to the cooking chamber door and with a connected operating lever exterior of the cooking chamber, said door locking bolt having an engagement surface, and said operating lever moving the bolt from a locking position to an unlocked position;

a sliding bolt having an engagement surface engageable with the engagement surface of the door locking bolt and mounted to the door opening adjacent to the door locking bolt when the door is closed, said sliding bolt and the locking bolt having corresponding camming surfaces so that moving the door to the closed position causes the locking bolt camming surface to strike the sliding bolt camming surface to cause the sliding bolt to move to allow movement of the sliding bolt past the locking bolt; and a triggering mechanism located at least partially inside the cooking chamber which can be actuated by a person in an interior of the cooking chamber and by which the sliding bolt can be moved from an engaging position to an unlocked position where the engagement surface of the sliding bolt cannot engage with the engagement surface of the door locking bolt independently of whether the door locking bolt is in the locking position or in the unlocked position, wherein the triggering mechanism connects to the sliding bolt through at least a part of a wall of the cooking chamber by a shaft of the triggering mechanism conducted at least partly through the chamber wall, and, wherein the shaft of the triggering mechanism has a lever element engaging the sliding bolt so that rotation of said shaft moves the sliding bolt to a retracted position from a locked position.

15. A cooking device of claim 14 wherein the shaft is connected by a linkage arrangement to a grating adjacent a floor of the chamber, so that application of weight of a person in the chamber on the grating causes rotation of the shaft to retract the sliding bolt.

16. A cooking device of claim 14 which includes a display unit which indicates presence of a person in an interior of the chamber, said display unit providing a signal selected from acoustical signals and optical signals, and said display unit being actuated by a sensor of the triggering mechanism.

17. A cooking device of claim 14 wherein the triggering mechanism moves the sliding bolt to said unlocked position by an actuating element, said actuating element being at least one of a lever, a pulling handle, a traction cable, a pushbutton, a turning wheel, and an element disposed at a floor of the interior of the chamber and movable by a person in the interior and connected to at least one transmission element in a form of a rodding, a fork mechanism, a cam, a cable pull, a gearing, and a deflection roller.

18. A cooking device according to claim 14 wherein the triggering mechanism is electromagnetically actuated and wherein the sliding bolt has one of an electromagnet and a permanent magnet mounted thereon and with a corresponding one of electromagnetic and permanent magnet being mounted in a housing receiving the sliding bolt.

19. A cooking device according to claim 18 which includes at least one sensor for detecting presence of a person in the interior of the chamber, said sensor being connected to an electrical circuit for the electromagnet so that a signal from said sensor causes movement of the sliding bolt to a retracted position to unlock the door.

20. A cooking device of claim 19 which includes a spring element urging the sliding bolt to a retracted position, and wherein energizing the electromagnet causes the sliding bolt to be moved to a position for engaging the locking bolt, and said sensor causes interruption of current applied to the electromagnet so as to allow the spring element to retract the sliding bolt.

21. A cooking device of claim 14 wherein the triggering mechanism shaft is conducted in substantially vapor-tight fashion through the chamber wall.

22. A cooking device of claim 14 wherein the sliding bolt is mounted in a frame of the door mounted to an outside surface of the chamber wall.

23. A cooking device of claim 14 wherein the door is free to move between the open and closed positions when the sliding bolt is in the unlocked position regardless of whether the door locking bolt is in the locking or the unlocked position.

24. A cooking device of claim 14 wherein a spring biases the sliding bolt into said engaging position.

25. A cooking device of claim 24 wherein the sliding bolt moves against the biasing spring to allow movement of the sliding bolt past the locking bolt when the sliding bolt camming surface strikes the locking bolt camming surface.

26. A cooking device comprising a walk-in cooking chamber having a door opening closed by a door, and a safety locking mechanism, said safety locking mechanism comprising:

a door locking bolt mounted to the cooking chamber door and with a connected operating lever exterior of the cooking chamber, said door locking bolt having an engagement surface, and said operating lever moving the bolt from a locking position to an unlocked position;

a sliding bolt having an engagement surface engageable with the engagement surface of the door locking bolt and mounted to the door opening adjacent to the door locking bolt when the door is closed, said sliding bolt and the locking bolt having corresponding camming surfaces so that moving the door to the closed position causes the locking bolt camming surface to strike the sliding bolt camming surface to cause the sliding bolt to move to allow movement of the sliding bolt past the locking bolt; and a triggering mechanism located at least partially inside the cooking chamber which can be actuated by a person in an interior of the cooking chamber and by which the sliding bolt can be moved from an engaging position to an unlocked position where the engagement surface of the sliding bolt cannot engage with the engagement surface of the door locking bolt independently of whether the door locking bolt is in the locking position or in the unlocked position, wherein the triggering mechanism connects to the sliding bolt through at least a part of a wall of the cooking chamber by a shaft of the triggering mechanism conducted at least partly through the chamber wall, and, wherein an actuation element is detachably connected to the shaft for rotating the shaft to move the sliding bolt to a retracted position, said actuating element being designed as a tool and being removable for selectively breaking a pane in a window of the door and for jimmying the door open.

27. A safety locking mechanism in a walk-in cooking chamber having a door opening closed by a door, comprising:

a door locking bolt mounted to the cooking chamber door and with a connected operating lever exterior of the cooking chamber, said door locking bolt having an engagement surface, and said operating lever moving the bolt from a locking position to an unlocked position;

a sliding bolt having an engagement surface engageable with the engagement surface of the door locking bolt and mounted to the door opening adjacent to the door locking bolt when the door is closed;

a triggering mechanism located at least partially inside the cooking chamber which can be actuated by a person in an interior of the cooking chamber and by which the sliding bolt can be moved from an engaging position to an unlocked position where the engagement surface of the sliding bolt cannot engage with the engagement surface of the door locking bolt independently of whether the door locking bolt is in the locking position or in the unlocked position, and the triggering mechanism connecting to the sliding bolt through a wall of the cooking chamber by a shaft of the triggering mechanism conducted in substantially vapor-tight fashion through the chamber wall by a sealing;

the shaft of the triggering mechanism having a lever element engaging the sliding bolt so that rotation of said shaft moves the sliding bolt to a retracted position as said unlocked position; and an actuation element detachably connected to the shaft for rotating the shaft to move the sliding bolt to a retracted position, said actuating element being designed as a tool and being removable for selectively breaking a pane in a window of the door and for jimmying the door open.

* * * * *